United States Patent [19]

Buckner

[11] Patent Number: 4,951,539

[45] Date of Patent: Aug. 28, 1990

[54] APPARATUS FOR CUTTING DUCT BOARD AND THE LIKE

[76] Inventor: James A. Buckner, Rte. 1, Box 616, Providence, N.C. 27315

[21] Appl. No.: 375,830

[22] Filed: Jul. 5, 1989

[51] Int. Cl.[5] ..... B26D 3/06

[52] U.S. Cl. ..... 83/884; 83/522.17; 83/564; 83/620; 83/622; 83/883

[58] Field of Search ..... 83/875, 876, 883, 884, 83/455, 522.25, 522.15, 522.16, 877, 620, 926 G, 926 H, 614, 454, 475, 574; 409/304

[56] References Cited

U.S. PATENT DOCUMENTS

| | | | |
|---|---|---|---|
| 442,738 | 12/1890 | Saltzkorn et al. . | |
| 3,242,780 | 3/1966 | Ried et al. | 83/5 |
| 3,274,868 | 9/1966 | Williams | 83/5 |
| 3,352,015 | 11/1967 | Galabert et al. | 33/32 |
| 3,420,142 | 1/1969 | Gale et al. | 90/24 |
| 3,515,019 | 6/1970 | Tyer, Jr. | 83/5 |
| 3,534,646 | 10/1970 | Tyer, Jr. | 83/614 |
| 3,605,534 | 9/1971 | Barr | 83/5 |
| 3,935,767 | 2/1976 | McClay, Jr. | 83/5 |
| 3,967,519 | 7/1976 | Esterly | 83/455 |
| 4,221,150 | 9/1980 | Bergfelt et al. | 83/884 |
| 4,379,419 | 4/1983 | Woock et al. | 83/875 |
| 4,411,183 | 10/1983 | Auer | 83/581 |
| 4,493,460 | 1/1985 | Buss | 83/937 |
| 4,513,649 | 4/1985 | Dricot | 83/883 |
| 4,524,894 | 6/1985 | Leblond | 83/875 |
| 4,589,194 | 5/1986 | Roy | 29/583 |
| 4,608,902 | 9/1986 | Ivey | 83/875 |
| 4,616,543 | 10/1986 | Gerber | 83/937 |

*Primary Examiner*—Hien H. Phan
*Assistant Examiner*—Hwei-Siu Payer
*Attorney, Agent, or Firm*—Richard E. Jenkins

[57] ABSTRACT

An apparatus which cuts grooves in duct board panel is provided which includes a cutting head assembly which travels transversely across the apparatus on a cross track which is mounted to travel along the length of the apparatus. The cross track is positioned according to indicia along the side of the apparatus which indicate where grooves should be cut to form a particular size air duct, and a plurality of different cutting blades carried by the cutting head are sequentially rotated into use to sequentially cut a plurality of differently shaped grooves across the duct board panel.

2 Claims, 5 Drawing Sheets

APPARATUS FOR CUTTING DUCT BOARD AND THE LIKE

DESCRIPTION

1. Technical Field

This invention relates generally to the art of cutting grooves in duct board or the like, and more particularly relates to an apparatus for cutting grooves in fiber glass duct board to facilitate forming the duct board into an air duct of rectangular cross section.

2. Background Art

As is known in the building trade, heating and air conditioning ducts (air ducts) are made in sections of rectangular cross section and formed from a sheet of fiber glass material. The fiber glass duct board panel from which a duct section is made normally comprises a flexible aluminum sheet material to which a thick layer of fiber glass insulation is adhered. To form a duct section from the fiber glass duct board panel, the panel is normally laid out flat on a table or the like and measurements made along a length of the panel in order to determine where to cut grooves across the length of the panel in order to facilitate bending the panel into the desired rectangular cross section shape for use as a section in a heating or air conditioning duct (air duct) system.

As a matter of choice, it is known to cut V-shaped grooves as well as grooves having other cross sectional shapes which facilitate bending of the duct board panel. The grooves may be either cut by means of a hand-held type cutting tool or by means of a cutting apparatus of either the motorized or manually actuated type.

Both manually actuated as well as motorized duct board panel cutting apparatus known heretofore have suffered deficiencies which are believed to be overcome by the apparatus of the present invention. Generally speaking, manually actuated duct board cutting apparatus have tended to be limited in their capabilities by virtue of the fact that they carry only a single cutting blade and thus cannot practically be used to cut a plurality of different cross section grooves in a single duct board panel section as may be desired. Typically, the manually operated fiber glass duct board cutting apparatus are used to cut V-shaped grooves in duct board. See, for example, the device disclosed in U.S. Pat. No. 4,608,902 to Ivey. However, other shapes of grooves may be cut in duct board panels by changing the blade of the cutting head.

On the other hand, motorized duct board cutting apparatus possess high speed if a single size of duct board section is being fabricated (for example 10×12 inch cross section duct). However, these apparatus require a significant amount of down time between the cutting of different size duct sections since the multiple cutting heads utilized thereby must be individually adjusted. See, for example, U.S. Pat. No. 3,515,019 to Tyer, Jr.; U.S. Pat. No. 3,605,534 to Barr; and U.S. Pat. No. 3,420,142 to Gale et al.

Recognizing the problems of the prior art apparatus for cutting duct board, applicant proposes in accordance with the present invention to provide a relatively simple and lightweight manually actuated apparatus which is capable of sequentially cutting a plurality of different cross section grooves in a duct board panel to facilitate the formation of duct board sections and which is further adapted so as not to require time consuming cutting head adjustment when changing from cutting one size of duct section to the cutting of a different size duct section.

DISCLOSURE OF THE INVENTION

In accordance with the present invention, applicant provides an apparatus for cutting duct board and the like comprising a substantially flat support surface for the duct board panels, a pair of tracks mounted on opposite sides of the support surface, an elongate cross track extending across the support surface and slidably mounted at each end thereof to a respective one of said pair of side tracks for movement therealong, a cutter head assembly slidably mounted on said elongate cross track for movement therealong and comprising a cutter head having a plurality of cutting blades secured in spaced-apart relationship around at least a portion of the outer surface thereof and which extend in the direction of movement of the cutter head assembly along the cross track, said cutter head being rotatable about a horizontal axis parallel to the length of the cross track so as to selectively bring individual blades into operative position above the support surface as needed to sequentially cut the desired grooves in duct board panels, and indicator means provided adjacent the length of at least one of the opposing sides of the support surface for indicating the desired location for cutting the spaced-apart grooves for at least one size of air conditioning duct or the like.

It is therefore a primary object of the present invention to provide a manually operated apparatus for cutting duct board and the like by sequentially cutting a plurality of grooves of varying cross section shape in a fiber glass duct board panel to enable the panel to be converted into an air duct or a portion of an air duct.

Another object of the invention is to provide an apparatus for cutting duct board and the like including a cutter head carrying a plurality of different cutting blades on the outer surface thereof and capable of being selectively rotated about a horizontal axis so as to bring a desired blade into operative position as needed for sequentially cutting grooves of different cross sections in the duct board.

A further object of the present invention is to provide an apparatus for cutting duct board and the like which is adapted to alternate between the cutting of duct board panels to form one size duct to the cutting of duct board panels to form another size duct without requiring time consuming adjustment of the cutting mechanism.

Some of the objects of the invention having been stated, other objects will now become evident as the description proceeds, when taken in connection with the accompanying drawings, in which:

BEST MODE FOR CARRYING OUT THE INVENTION

Figure 1:
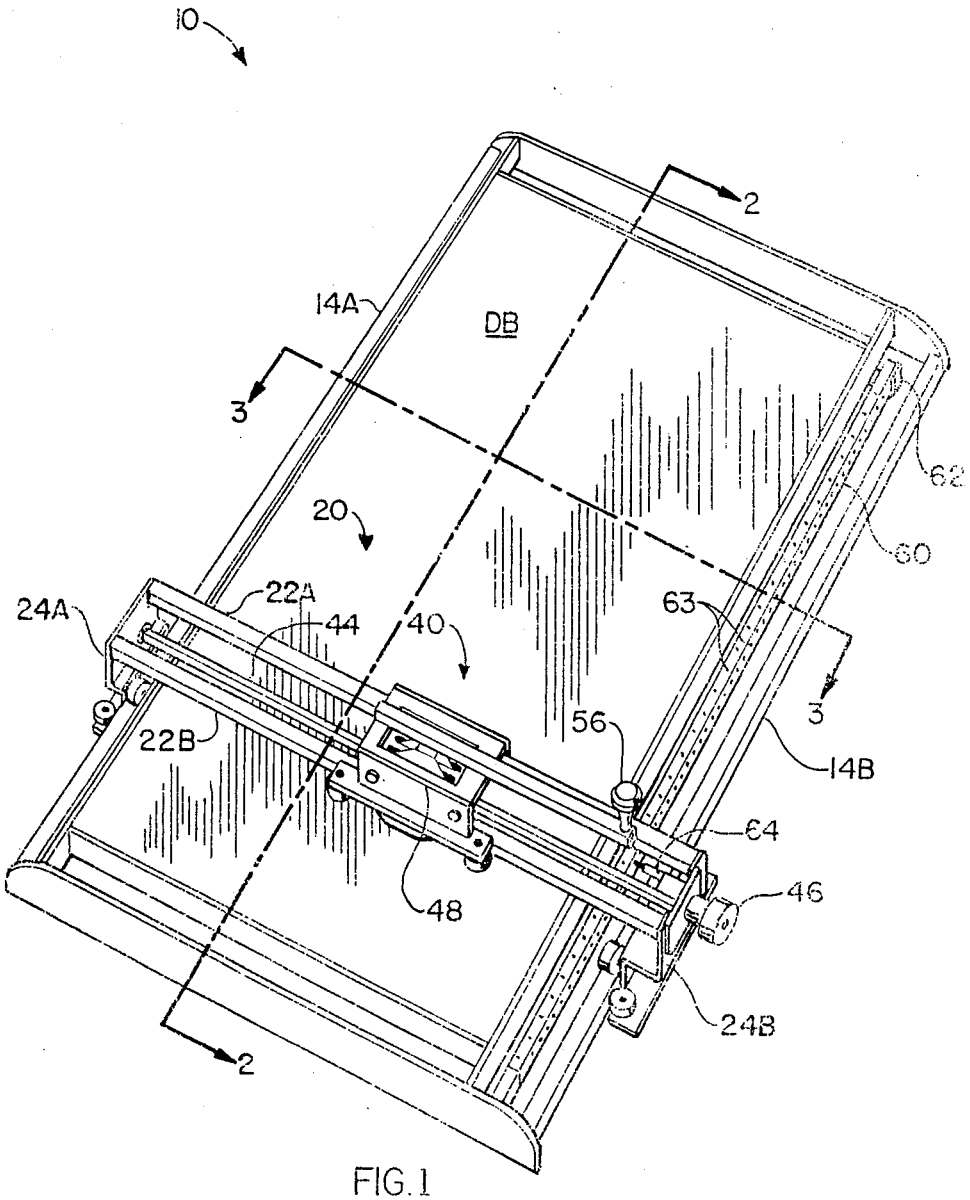
FIG. 1 is a top perspective view of a duct board cutting apparatus embodying the present invention.
Figure 2:
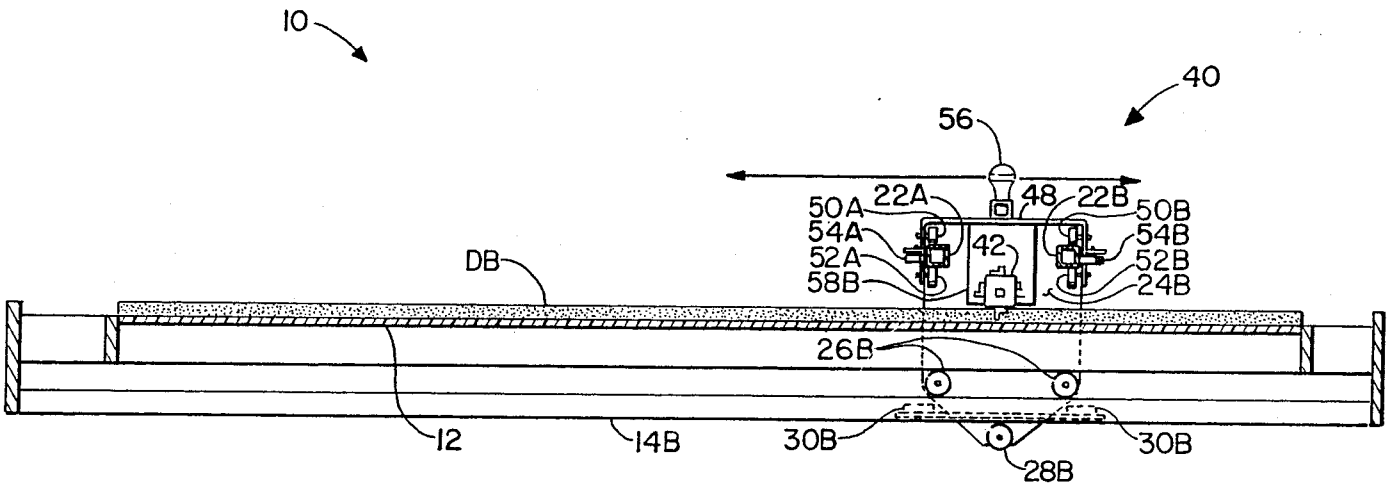
FIG. 2 is a sectional view taken in the direction of line 2—2 of FIG. 1.

Referring now in detail to FIGS. 1–6 of the drawings, the apparatus for cutting duct board and the like to form heating and air conditioning ducts (air ducts) or portions of these ducts is generally designated 10. Apparatus 10 comprises a four-sided flat support surface 12 upon which the duct board DB to be cut is placed and positioned for cutting. A pair of shafts 14A, 14B are mounted parallel to each other and adjacent to opposite sides of support surface 12 and serve as tracks for elongate cross track, generally designated 20, to travel to and fro on as will be described in more detail below.

Cross track 20 includes two parallel shafts 22A, 22B which extend across support surface 12 and are joined at opposing ends to cross track support ends 24A, 24B. Cross track support ends 24A, 24B carry respective upper roller pairs 26A, 26B, lower rollers 28A, 28B and lateral roller pairs 30A, 30B to rotatably engage shafts 14A, 14B and allow cross track 20 to be easily rolled along the shafts from one end of support surface 12 to the other end as needed.

The duct board groove cutting head assembly, generally designated 40, is slidably mounted on cross track 20 for movement along parallel shafts 22A, 22B of cross track 20 and thereby transversely across support surface 12 in order to cut a linear groove in duct board panel DB positioned on support surface 12. Cutter head assembly 40 includes a cutting head 42 carried thereby which includes cutting blades 42A–42D secured to each of the four sides thereof in any suitable fashion and oriented in the direction of movement of cutter head 42 along cross track 20. Cutter head 42 is slidably mounted on rod 44 with linear bearing 45, and rod 44 extends parallel to the length of cross track 20 and is rotatably mounted at each end thereof to cross track support ends 24A, 24B. Rod 44 may be rotated by cutter head adjustment knob 46 which includes a spring-loaded stop pin 46A on the inside surface thereof which engages four apertures (not shown) positioned at 90° intervals on the outside surface of cross track support end 24B around the perimeter of the aperture (not shown) through which rod 44 extends. In this fashion, cutter head adjustment knob 46 may be rotated in 90° increments in order to place a desired one of blades 42A–42D into operative position above support surface 12 so as to cut a groove in duct board DB positioned thereon when cutter head assembly 40 is pushed along the length of cross track 20.

Figure 5B:
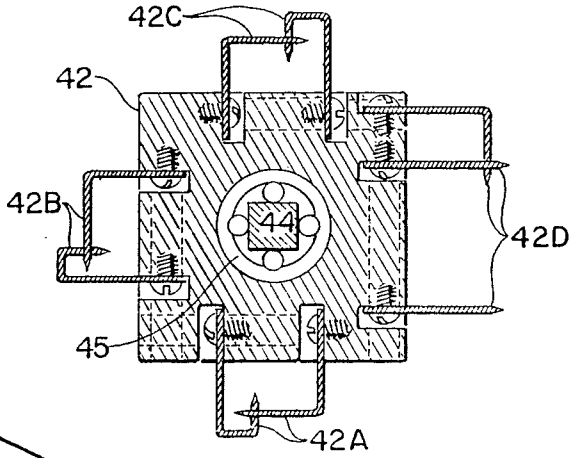
FIG. 5B is a cross section view of the cutting head of the apparatus of the present invention.
Figure 5C:
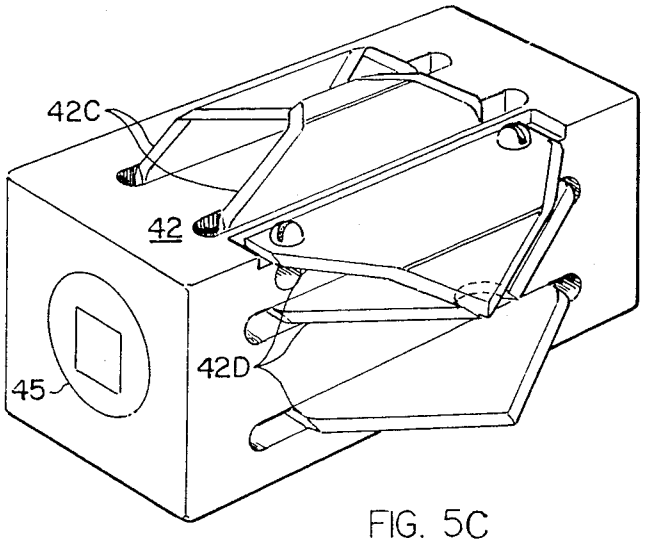
FIG. 5C is a perspective view of the cutting head of the apparatus of the present invention.
Figure 5A:
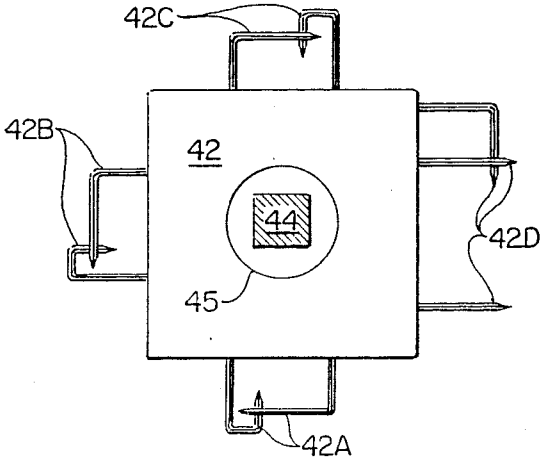
FIG. 5A is an end elevation view of the cutting head of the apparatus of the present invention.
Figure 6:
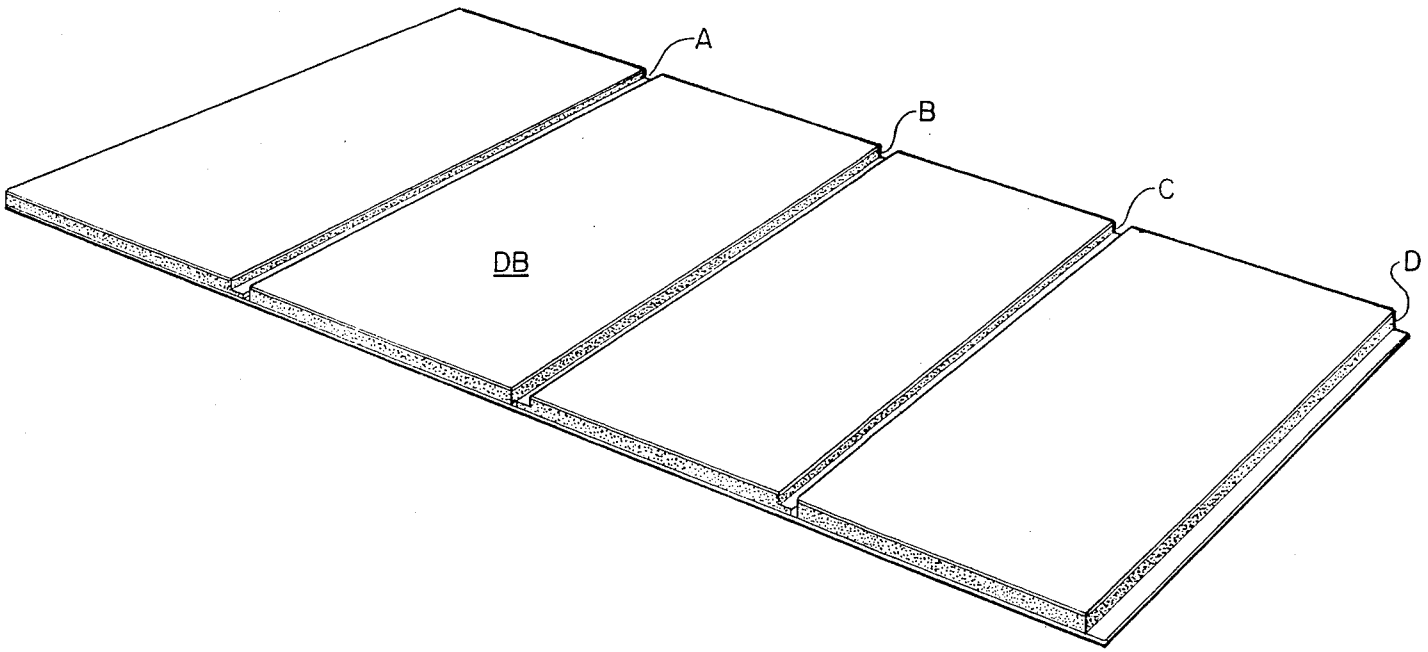
FIG. 6 is a perspective view showing a duct board panel after having four grooves cut therein by the apparatus of the present invention and ready to be formed into an air duct.

With reference again to the drawings, particularly FIGS. 5A–5C, it should be emphasized at this time that cutting blades 42A–42D have a plurality of different shapes in order to cut a plurality of different cross section grooves in a duct board panel to be bent into an air duct. For example, and with reference to fully cut panel DB depicted in FIG. 6, blade 42A will cut a "right cut" groove A when cutter head 42 is pushed across duct board panel DB positioned on support surface 12 of cutting apparatus 10, blade 42B will cut a "left cut" groove B, blade 42C will cut a "right cut" groove C, and blade 42D will make an "end cut" groove D on the panel. Thus, a sequence of four cuts are made across duct board panel DB with cutter head 42 and the panel is then folded along the cuts into a rectangular cross section air duct. It should be emphasized that applicant's apparatus allows for sequentially selecting one of a plurality of blades to form a plurality of different cross section grooves in a duct board panel from a single cutting head. The variation in groove shape is desirable in many instances over the more traditional uniform V-cuts which are known in the art.

Figure 3:
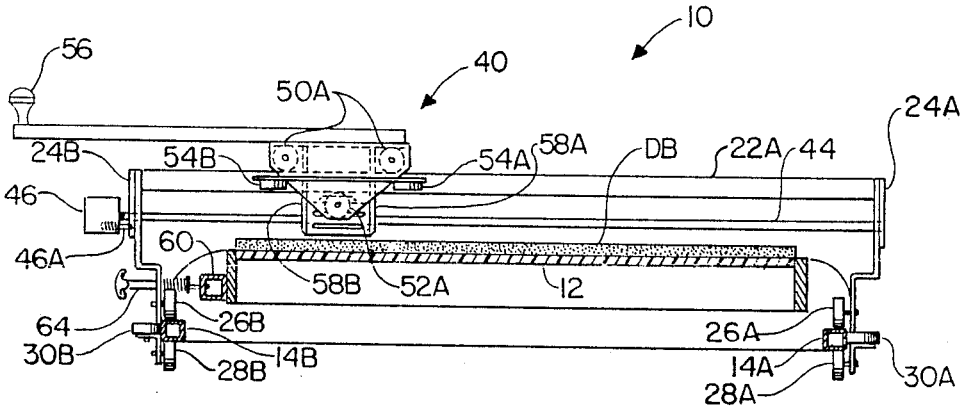
FIG. 3 is a sectional view taken in the direction of line 3—3 of FIG. 1.
Figure 4:
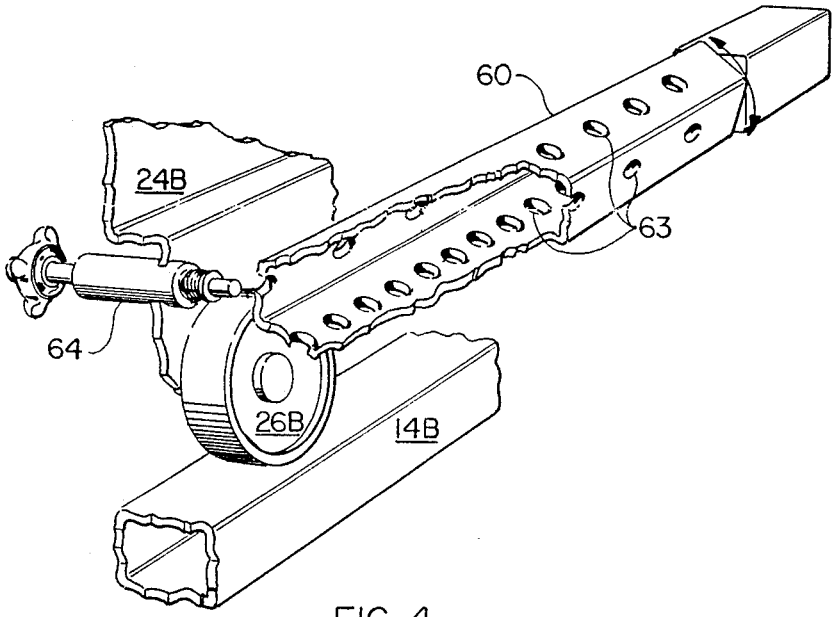
FIG. 4 is an enlarged fragmentary view of the sizing bar of apparatus of the present invention.

With an appreciation of the features of cutter head 42 of apparatus 10, it can further be seen that cutter head 42 is carried by cutter head support housing 48 which is movably mounted on parallel shafts 22A, 22B of cross track 20. With reference to FIG. 3, one side of cutter head support housing 48 travels on shaft 22A by virtue of inside upper roller pair 50A and lower roller 52A as well as outer roller pair 54A which rotatably engage shaft 22A. On the other side of cutter support housing 48, inside upper roller pair 50B and inside lower roller 52B as well as outside roller pair 54B rotatably engage shaft 22B. A handle 56 is secured to the top of cutter head support housing 48 and is used to push support housing 48 along cross track 20 in order to force cutter head 42 to cut a desired groove across duct board panel DB positioned on support surface 12. Finally, to complete the description of the construction of cutter head assembly 40, it can be seen with particular reference to FIG. 2 that cutter head 42 is secured to support housing 48 and rotatably carried by front and rear support plates 58A, 58B, respectively.

In order that the operator of apparatus 10 may know where to position cross track 20 in order to cut the required four spaced-apart grooves for a particular cross section size air duct, applicant provides a means of measurement comprising a sizing bar, generally designated 60, which extends along the length of one side of support surface 12. The sizing bar is held at its free end by bracket 62 and includes a female/male mounting (not shown) at the opposite end so that sizing bar 60 may be lifted up at its free end, turned to a desired side, and replaced in its bracket 62. Sizing bar 60 includes indicia on each side thereof indicating where grooves should be cut across duct board panels for different size air ducts. For example, one side may include the four groove cutting points for four air duct sizes ranging from 10×12 to 10×14 and the remaining three sides include cutting indicia for an additional twelve different size air ducts. Corresponding to each cutting indicia is an aperture 63 in sizing bar 60 which will accept stop pin 64 carried by cross track support end 24B of cross track 20. Thus, it can be appreciated that applicant's inventive apparatus allows for making four cuts for, by way of example, a 10×12 inch cross section air duct on one piece of duct board and making four differently spaced-apart cuts in the next piece of duct board panel to form a 10×14 inch cross section air duct. Apparatus 10 does not require any adjustment of cutting head 42 in order to switch from cutting one size of air duct to another size of air duct. Moreover, and also very importantly, applicant's apparatus further allows the ability to sequentially cut up to four different grooves (depending upon the number of different blades carried by cutting head 42) in a duct board panel to be then folded into a rectangular cross section air duct configuration. These features are believed to be unique to applicant's invention.

In operation, one merely places a duct board panel on support surface 12 of apparatus 10. Cutter head assembly 40 is pushed to either end of support surface 12 and cutting head 42 rotated with adjustment knob 46 so as to bring a desired cutting blade 42A–42D thereof into its operative mode opposing support surface 12. Cutter head assembly 40 is then pulled to the operator side of cross track 20 adjacent sizing bar 60 and cross track 20 is moved along parallel shafts 14A, 14B to the indicia on sizing bar 60 indicating the position where the first groove should be cut in the duct board. Stop pin 64 is now inserted into the aperture corresponding to the position indicia for the first groove to be cut in order to stabilize cross track 20 at the proper location. Next, handle 56 is pushed in order to force cutting head 42 across the duct board and thereby cut the desired groove thereacross. Next, stop pin 64 is withdrawn and cross track 20 moved further across the duct board panel to the indicia indicating the place for the second groove to be cut across the duct board panel. Cross track 20 is again stopped and secured at this point with stop pin 64 and the cutting head at the remote end of cross track 20 is rotated with cutter head adjustment knob 46 to position the next desired blade of cutter head 42 into its operative mode above support surface 12. Handle 56 is then engaged by the operator and cutting head 42 pulled toward the operator so as to cut the second desired groove in the duct board panel. In this same fashion, the third and fourth grooves are also cut in the duct board panel, and the panel is removed from apparatus 10 for subsequent folding and processing into the final air duct segment.

It will be understood that various detail of the invention will be changed without departing from the scope of the invention. Furthermore, the foregoing description is for the purpose of illustration only, and not for the purpose of limitation—the invention being defined by the claims.

What is claimed is:

1. An apparatus for sequentially cutting spaced-apart linear grooves in panels that are to be bent at the groove locations to form air ducts, said apparatus comprising:

a substantially flat four-sided support surface for said panels;

a pair of tracks mounted parallel to each other and adjacent opposite sides of said support surface;

an elongate cross track extending across said support surface and slidably mounted adjacent each end thereof to a respective one of said pair of parallel side tracks for movement along said side tracks;

a cutter head assembly slidably mounted on said elongate cross track for movement along said cross track and comprising a four-sided cutter head having a plurality of cutting blades secured in spaced-apart relationship to at least two sides thereof and which extend in the direction of movement of said cutter head assembly along said cross track, said cutter head being rotatable about a horizontal axis parallel to said cross track so as to selectively bring individual blades into operative position above said support surface as needed to sequentially cut said linear grooves in said panels;

indicator means provided adjacent at least one of the sides of said support surface for indicating locations for cutting the spaced-apart grooves for at least one size of air duct; and means for locking said cross track carrying said cutter head assembly at said locations along said indicator means comprising apertures corresponding to indicia on said indicator means and a stop pin carried by said cross track adapted to be removably inserted into selected apertures.

2. An apparatus for sequentially cutting spaced-apart linear grooves in panels that are to be bent at the groove locations to form air ducts, said apparatus comprising:

a substantially flat four-sided support surface for said panels;

a pair of tracks mounted parallel to each other and adjacent opposite sides of said support surface;

an elongate cross track extending across said support surface and slidably mounted adjacent each end thereof to a respective one of said pair of parallel side tracks for movement along said side tracks;

a cutter head assembly slidably mounted on said elongate cross track for movement along said cross track and comprising a square cutter head having a cutting blade secured to each side thereof which extends in the direction of movement of said cutter head assembly along said cross track, said cutter head being rotatably mounted on a horizontal shaft which extends from one end of said elongate cross track to the other end so as to selectively bring individual blades into operative position above said support surface as needed to sequentially cut said linear grooves in said panels;

indicator means provided adjacent at least one of the sides of said support surface for indicating locations for cutting the spaced-apart grooves for at least one size of air duct; and means for locking said cross track carrying said cutter head assembly at said locations along said indicator means comprising apertures corresponding to indicia on said indicator means and a stop pin carried by said cross track adapted to be removably inserted into selected apertures.

* * * * *